US010946935B2

(12) United States Patent
Fraser et al.

(10) Patent No.: US 10,946,935 B2
(45) Date of Patent: Mar. 16, 2021

(54) SHADE APPARATUS FOR PERSONAL WATERCRAFT (PWC)

(71) Applicants: Judi Fraser, Shalimar, FL (US); Edward C. Lewis, Shalimar, FL (US)

(72) Inventors: Judi Fraser, Shalimar, FL (US); Edward C. Lewis, Shalimar, FL (US)

( * ) Notice: Subject to any disclaimer, the term of this patent is extended or adjusted under 35 U.S.C. 154(b) by 0 days.

(21) Appl. No.: 16/859,717

(22) Filed: Apr. 27, 2020

(65) Prior Publication Data

US 2020/0339227 A1 Oct. 29, 2020

Related U.S. Application Data

(60) Provisional application No. 62/839,469, filed on Apr. 26, 2019.

(51) Int. Cl.
*B63B 17/02* (2006.01)
*B63B 34/10* (2020.01)

(52) U.S. Cl.
CPC ..... *B63B 17/02* (2013.01); *B63B 34/10* (2020.02)

(58) Field of Classification Search
CPC . B63B 17/02; B63B 17/023; B63B 2017/026; B63B 34/10
See application file for complete search history.

(56) References Cited

U.S. PATENT DOCUMENTS 5,520,139 A * 5/1996 King ..... B63B 17/02 114/361
5,697,320 A * 12/1997 Murray ..... B63B 17/02 114/361
5,743,208 A * 4/1998 Miller ..... B63B 17/02 114/361
5,904,114 A * 5/1999 Wright ..... B63B 17/02 114/361
6,223,680 B1 * 5/2001 Frink ..... B63B 17/02 114/361
6,637,364 B1 * 10/2003 Campeau ..... B63B 17/02 114/361
7,438,345 B2 * 10/2008 Mrotek ..... B60J 7/1226 296/116

* cited by examiner

*Primary Examiner* — Ajay Vasudeva
(74) *Attorney, Agent, or Firm* — Michael L. Greenberg, Esq.; Greenberg & Lieberman, LLC

(57) ABSTRACT

A shade canopy configured for use on all model Personal Watercrafts (PWC) is described. A Bimini Top provides shade from the sun to occupants of the PWC. The bimini top provides the ability to board and unboard from the sides of the PWC. This apparatus also folds and stores on the rear of the PWC and is contained in a zippered boot with straps. The bimini top supports a permanent or non-permanent mounting system to the hull to avoid hull modification. Two variants, a folding or telescoping support structure are available which facilitate accessories such as racks and coolers that attach to the rear of the PWC. Straps positioned around the PWC tension to the apparatus, ensuring the Bimini Top remains taut, and that the Bimini Top does not angle fore, aft, left or right. The straps are affixed to the PWC using existing mooring points on the PWC or via an add-on kit.

10 Claims, 19 Drawing Sheets

FOLDING TUBE HINGE

Marine "Eye End" for Frame Tubing

Sliding and Locking Marine Jaw Hinge

Tether Straps, Tensioners and Snap Links

180 Degree Deck Hinge and Fasteners

Fiberglass and Non-Fiberglass Hull Mounting Fasteners

Zippered Storage Boot with Tie Down Straps

Rubber and Plastic Tube Holders

GENERAL FRONT AND REAR TUBE FRAME ARRANGEMENT

Transom Mooring Ring Kit and Fasteners

Hinged Variant Folding Scheme
FABRIC TOP REMOVED FOR CLARITY

Telescoping Tubes on Lateral and Vertical Supports
Fabric Removed for Clarity

Fabric Top – Bottom Detail

Non-Permanent Shade Apparatus Mounts

Contour 3
Strap & Bolt Variants
Left Side Shown
Right Side Mirror Image

Non-Permanent Shade Apparatus Mounts

Accessory Weather Curtains For Use When Docked or Beached

SHADE APPARATUS FOR PERSONAL WATERCRAFT (PWC)

CONTINUITY

This application is a non-provisional application of provisional patent application No. 62/839,469, filed on Apr. 26, 2019, and priority is claimed thereto.

FIELD OF THE PRESENT INVENTION

The present invention relates to the field of canopy, awning, and shade systems, and more specifically relates to a shade apparatus configured for use on personal watercrafts (PWC) such as Jet Skis™, SeaDoo™, Waverunner™, and the like.

BACKGROUND OF THE PRESENT INVENTION

It is known that shade is a desirable comfort on sunny days, especially out on the open water. Boats (including hard hull boats, inflatable boats, kayaks, and other watercraft) are commonly equipped with Bimini Tops or similar awning structures to provide shade to occupants of the watercraft. Such shade elements are commonly erected with a canvas (or canvas-like) top supported by aluminum or stainless-steel tube style support poles shaped into a frame. For many pleasure and sporting watercraft, these awning structures facilitate folding of the top for high speed operation, trailering, or when the watercraft is stored. Unfortunately, no bimini top shade systems are available for PWCs. There are significant design challenges for PWCs due to their size, multitude of hull shapes and higher performance that perhaps have contributed to no effort begin made to make a commercially viable design available until now.

Commonly available Bimini Top shade systems are typically equipped with nearly equal length vertical support poles shaped liked the letter "V" and are connected at the bottom where they attach to each side of the boat hull using a typical deck hinge. A few others use single large diameter poles such as on center console boats, or arches used on some recreational boats, and are attached using a variety of mounting systems. Due to the placement of typical V shaped support structures, entry and exit from the sides of the boat while the shade structure is up is difficult, if not impossible, restricting the occupants to entering and exiting the boat from the bow or stern.

Additionally, such shade systems currently available on the market are not made for Jet ski or Waverunner type vessels, and do not scale down well to them. Even in instances in which typical Bimini Top are scaled down to provide effective shade for smaller boats, inflatables, or kayaks, even these do not fit a PWC in length, height, or width with their conventional support pole designs and hull mounting mechanisms.

A typical boat shade apparatus and pole support system scaled down for a PWC makes boarding and/or un-boarding the PWC from the side nearly impossible due to vertical support pole locations crossing the sitting areas along the sides and associated tie down strap locations and mounting. PWC drivers and passengers board and un-board PWCs from the side most of the time, similar to a motorcycle. It is critical for a PWC driver and passengers to un-board from the sides during an emergency and not take turns existing from the rear. Boarding and un-boarding a PWC front the front is inherently impossible due to the inherent hull design.

Boarding and un-boarding a PWC from the rear also is also performed under certain circumstances. If on a pier and trying to board a PWC in deep water, it is impossible to board from the rear and requires side boarding.

Boat Bimini Tops must be folded down for high speed water operation and when trailered behind a vehicle on a highway. This is required due to structural limitations imposed by the Bimini Top manufacturers. This will be true for a new Bimini Top designed for a PWC. Typical boat bimini frame "V" shape design is based on the vertical support tubes begin nearly equal length to spread the fabric top as far apart as possible over the riders' heads for shade. When this V shape frame is folded rearward on a boat it will typically clear the passenger seating area due to the vertical support tubing length and central mounting position on each side of the hull.

When scaling down a typical V-shaped Bimini Top for use on a PWC, some dimensions cannot be reduced too far such as the vertical height over the riders. Many PWCs use "stadium seating" whereas the front driver is in the lowest position and most aft passenger on a 3 person PWC is in the highest seating position. Headroom clearance has to be maintained between the riders heads and the Bimini Top fabric based on their seating positions for two primary reasons. The first is clearance to accommodate vertical rider movement when going across waves, swells and the wakes of other proximal watercraft. The second, and most important, is the headroom clearance for the driver and passengers must have sufficient height to allow clear 360-degree visibility in all directions under all normal operating conditions. These factors control the minimum length of the vertical support tubing based on anthropomorphic male and female sitting heights based on 5th through 90th percentile models. Therefore when a "V" Shape frame scaled for a PWC is folded rearward, the vertical support tubes of the frame, cross connecting tubes, and fabric top will extend past the rear transom of the PWS hull and can drag in the water on many PWC hull designs. This assembly in or close to the water behind the PWC can be caught up in the water coming out of the jet pump and could rip the entire shade structure off the rear of the PWC endangering the driver and passengers. In addition, with the frame extending over the rear of the PWC out behind the rear deck, the critical first step when trying to board from the rear is severely impeded. This is even more critical if a rider is in deep water over their head and trying pull themselves up and board from the rear with a tube frame and fabric in the way.

Other PWC hull designs have side contours that would prevent folding a shade apparatus relatively flat and the support poles would have to stick upwards of a 30-40 degree angle off the rear of the PWC. This too causes safety concerns for riders relative to pinch and head strike hazards during normal and emergency boarding and un-boarding. It can also cause stability problems with additional weight far behind the rear of the hull as well as additional aerodynamic drag. Having these poles stick upwards at a 30-40 degree angle will also cause unacceptable amounts of stress leading to fatigue then failure on the hull mounting system due to the leverage and moment arm of the tubing. These concerns are even more amplified in rougher water and over long periods of use.

Canvas tops used for even smaller boats are too large for a PWC, and if fitted to a frame will cause undue "parachuting" or undue aerodynamic drag that can cause severe safety problems on PWC handling during forward movement and turning, even more so with a headwind. Smaller canvas tops used on some Kayaks and similar size watercraft are not made to withstand motorized operation speeds and provide completely inadequate shade coverage on a PWC.

In summary, a shade system that can meet the performance parameters of a PWC and can stow properly is needed in the marketplace.

The top hull material of PWCs now ranges from standard fiberglass about ¼ in thick to fiber reinforced plastic (FRP) less than ¼ inch. Standard deck hinge mounting techniques with just screws cannot be used on PWCs since they are higher performance and subject to more G forces, vibration, and overall movement than boats. Simply screwing deck hinges into PWC hull material will not work and is not safe because they will erode the fiberglass and pull out.

The top hull designs of PWCs have changed significantly over the last 20 years between manufacturers and new models come out with variances yearly. Standard fixed position Deck hinges only work on certain models from the early 2000's. Most PWCs used a tremendous variety of compound upper hull shapes and contours. This necessitates using a deck hinge that would universally accommodate upper hull designs laterally and longitudinally to mount the shade structure tube frame and be of sufficient strength and security. Standard and other types of deck hinges typically require drilling holes for mounting and securing. However, some users will not want to put holes in their PWCs for cosmetic reasons. This is because attaching shade structures or Bimini Tops, are not yet a norm in the PWC community as it is with boats. Other users will not have the technical skill to perform a mount installation. Therefore, a quick attach, "no-scar", non-permanent hull mount is also warranted for some customers.

Typical industry-wide Bimini Top securing straps and their attachment rings for boat shade structures do not meet PWC requirements. The typical securing rings for straps require mounting with screws into the hull and only accommodate the typical small attaching clips used on boat Bimini Top straps. Standard Bimini Top strap clips that attach into the rings mounted on the hull are unsafe to use on a PWC shade system because they have been tested and found not to be of sufficient strength. The clips attached to the straps are similar to the letter "J" with a spring loaded metal strip across the open part. The "J" clip being open ended is subject to bending and opening of the clip under the higher loads and stresses encounter with PWC operations that have been tested. In addition, some PWCs due to their OEM manufacturer design, will have to have an additional ring type securing method permanently added to the rear transom for securing straps to attach to the hull.

This PWC apparatus utilizes a stainless-steel closed carabiner style clip to secure straps to a PWC.

As compared to boat Bimini Tops that sometimes use heavy stainless-steel support structures, a PWC shade system has to be as light as possible since the overall PWC is lighter and more susceptible to weight and balance changes.

Compared to boat Bimini Tops, a PWC shade system has to have a universal fit in length and width to accommodate all the models of PWCs along with a similar universal frame system.

A PWC shade system canvas has to be sized correctly to prevent "parachuting" that causes unsafe aerodynamic drag when in forward motion and with headwinds.

The frame must be able to attach accessories that enhance the utility of the overall apparatus and accommodate certain third party after market accessories.

If there were a shade system that could provide the following features it would be widely adopted:

- Provide PWC users protection from the sun they never had before with minimal aerodynamic effects on performance
- Allow side boarding and un-boarding, maintaining rear boarding and un-boarding options
- Be able to fold or collapse and secure the shade system to the PWC for high speed operation or when being trailered.
- Have a universal hull mounting system to accommodate the wide variety of PWCs
- Have the option for permanent and non-permanent hull mounting systems.
- Have a secure tether mounting system with strong fasteners that require the least amount of modification to the PWC
- Be light weight
- Have a universal fit in length and width for PWCs
- Be able to add accessories that enhance the utility if the shade system and accommodate certain third party after market accessories
- Be easy to install and to remove In short, the market is presently lacking a good PWC shade system as well as a mounting apparatus to attach it to the PWC. Simply scaling down a boat shade structure will not be adequate without compromising safety in several areas.

SUMMARY OF THE PRESENT INVENTION

The present invention is a shade system and apparatus configured for installation and use on Personal Watercrafts (PWCs). Differing from current canopy/shade systems on the market fashioned for use on boats, inflatables, kayaks, and the like, the present invention exhibits a design configured to not impede occupants' capacity to board and/or dismount from the sides of a PWC while the shade apparatus is erected; provides folding/collapsing methods for high speed operations and trailering and storage; has a universal hull mounting system to accommodate the wide variety of PWCs with options for permanent and non-permanent hull mounting structure; provides securing strap attachment methods for newer PWC models that are not a permanent modification and for older PWCs a permanent retrofit kit can be provided; is light weight using predominantly aluminum parts; has universal fit for PWC models in the marketplace; has the ability to add accessories and accommodate certain third party after market accessories; is easy to install, operate and remove.

The present invention is equipped with a Bimini canvas or polyester top, a right folding (or telescoping) upright support strut, a left folding (or telescoping) upright support strut, a right lateral folding (or telescoping) support, and a left lateral folding (or telescoping) support. All support struts are connected to a permanent or non-permanent universal hull mount for the PWC used.

The system is maintained in position via four tether straps, each configured to be removable and are affixed to the existing hook, loop, or cleat components conventionally found on the front and rear hull of most PWCs. Front tether straps are connected via stainless steel snap links to an additional double-ended strap that is tied to the front towing bar found on all PWCs affording a non-permanent installation of the system. The rear tether straps are connected using a stainless-steel snap link to the metal mooring loops on the rear transom of the PWC. For PWCs without factory installed rear metal mooring loops on the rear transom, a permanent loop-type add-on kit is provided. As such, the present invention is configured to be easily installed by a user with some mechanical skills for the permanent mounting method, or with minimal skills using the non-permanent hull attach method. The four tether straps employ adjustable tension mechanisms in order to ensure that the shade apparatus remains upright in the desired position. Due to the nature of the layout of the lateral supports, occupants can easily enter and exit the PWC from the sides and rear without needing to take down the shade apparatus.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein:

FIG. 19 exhibits a flow chart detailing the process of installation of the apparatus of the present invention to a PWC.

DETAILED DESCRIPTION OF THE PREFERRED EMBODIMENT

Figure 1:
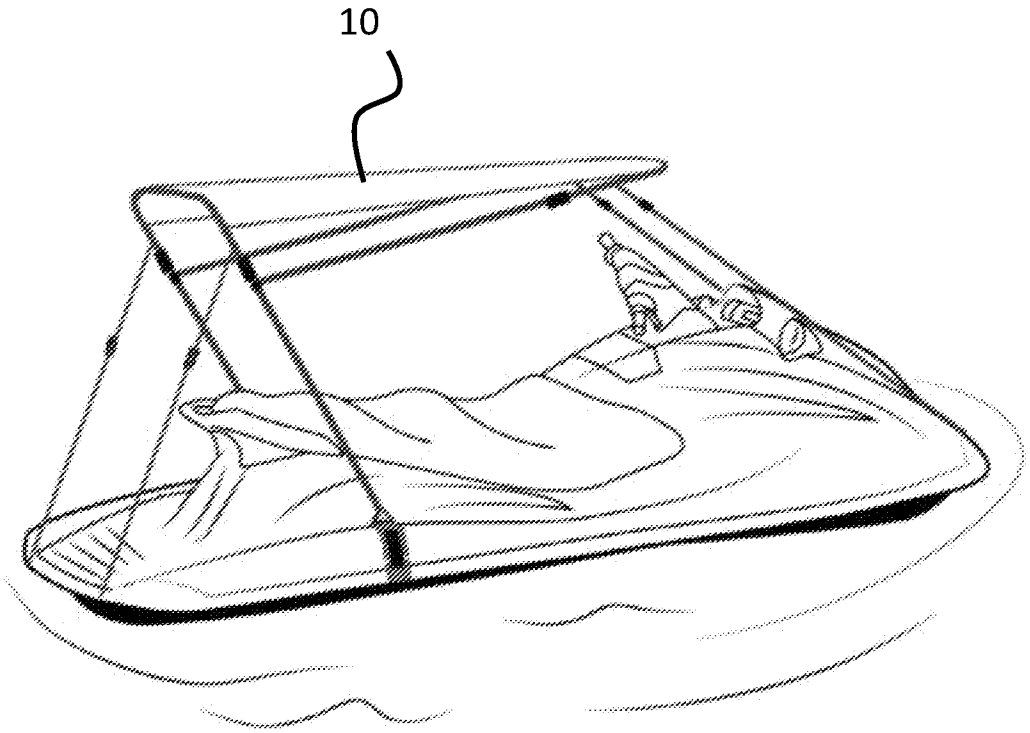
FIG. 1 shows the apparatus of the present invention without labeling for clarity.

The present specification discloses one or more embodiments that incorporate the features of the invention. The disclosed embodiment(s) merely exemplify the invention. The scope of the invention is not limited to the disclosed embodiment(s). The invention is defined by the claims appended hereto.

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

The present invention is a Personal Watercraft (PWC) two-frame shade apparatus configured to facilitate the shading of passengers while ensuring adequate access venues to and from the watercraft. Unlike other Bimini Tops on the market, the present invention is unique as it is designed specifically for PWCs as a universal fitment. This unique apparatus design abandons traditional frame tube assemblies that look like the letter "V" whereas the bottom of the letter "V" is where the frame attaches to the hull and the top open part of the "V" is where the canvas is stretched across. Traditional "V" shaped frame designs prevent side boarding and unboarding. Many PWC manufacturers and third-party companies now manufacture and sell accessories such as coolers and racks that mount to the rear deck of the PWC. These accessories prevent boarding from the rear making side boarding and unboarding a necessity, and an old-style V shape bimini top frame will not work.

Instead with this apparatus, the unique design approach is the front frame is connected to a rear vertical frame and raised to a high position with the canvas stretched between both frames. This allows unobstructed easy boarding and unboarding from either side similar to a motorcycle and preserves the ability to board from the rear if no accessories are used that prevents doing so.

The apparatus is unique in that there are two variants derived from the same engineering basis that are identical in form factor, except for how they adjust to the length of a PWC. Both embodiments support fitment on different manufacturers' hull designs and new concept PWC designs. One has a stainless-steel folding hinges and the other has a collapsible telescoping tube system, of which both allow the frame with canvas top to be folded or collapsed back and stowed onto the rear of a PWC.

The folding or telescoping of the shade apparatus is also a critical unique design feature to keep the frame and canvas from being dragged in the water and prevent damage or personal injury if the apparatus was caught by water coming from the PWC jet pump that propels the vessel.

The apparatus is also unique in that it has both a permanent and non-permanent hull mounting system based on user preference.

The permanent mounting system has two variants: one for standard fiberglass upper hulls, and the other for upper hulls that are not fiberglass. In general, the mounting systems consists of four hull anchors (two per side) that mount through the hull, four stainless steel fasteners, two 180-degree deck hinges and two optional rubber pole holders. Both variants require drilling holes in the upper hull with the gunwales as the preferred locations although certain other areas of the upper hull can be used. The pole holders are used to keep the frame tubes that are folded back on the rear from contacting the hull surface and marring it. All components are commercial off-the-shelf as individual items but are unique in that each has been tested and selected out of hundreds of candidates for their unique properties and suitability for the apparatus design and formed into special mounting kits.

The fiberglass hull mounting system utilizes a polymer expanding anchor that a stainless-steel screw fastens into. This expanding anchor is not simple plastic but a polymer that seals itself around and under the hull fiberglass to prevent loosening and also seals around the screw for security and makes a watertight seal. Two per side of the hull are required. The stainless-steel screws fasten each 180-degree deck hinge to the hull.

The mount for non-fiberglass upper hulls utilizes a stainless steel metal anchor that is inserted through a hole drilled into the hull, then turned flat using plastic leads, a collar is them slid down to hold the metal plate in place and the leads are snapped off by hand, then a stainless steel bolt can be inserted. Two of these stainless-steel metal anchors (or backing plates) are used per each side of the hull. The bolts are used to attach the 180-degree deck hinge (120) to the hull.

The non-permanent mount system embodiment of the present invention does not require the PWC owner to drill holes into the PWC in order to install the shade top, but instead employs a unique clamp on mount or metal plate with re-closable fastening material that is dependent on the hull type and manufacturer. As part of the hull mounting system the same 180-degree stainless steel deck hinge (120) used for the permanent mount system is also used to accommodate the vast shapes and contours of PWC upper hulls.

Figure 15:
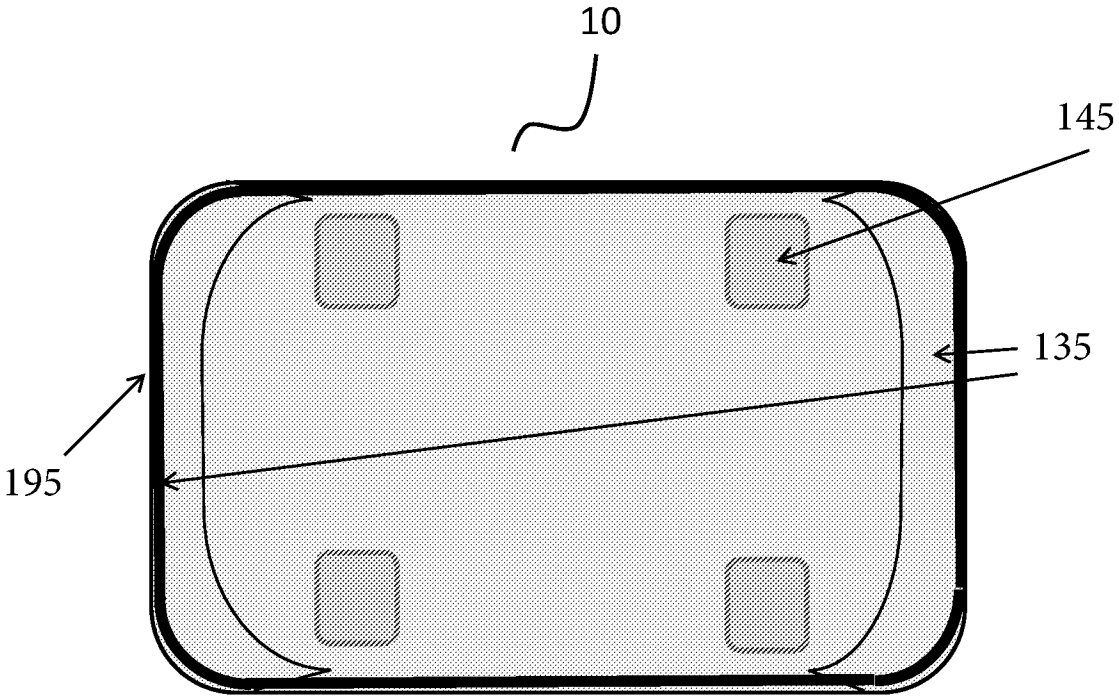
FIG. 15 shows the fabric bimini top of the present invention as seen from the bottom of the bimini top, detailing the pockets for cross pieces of the tube frames of the present invention.

The 180-degree stainless steel deck hinge (120) is a commercial off-the-shelf unit that has never been considered for PWC use until now, and has three components. The outer shell has two holes for fasteners to go through and fits over the rest of the assembly to hold it in place. The inner stainless-steel assembly consists of two joined forks that can move laterally left and right 180 degrees. Underneath the fork assembly a rubber pad is inserted that induces tension and dampening on the fork assembly when the outer shell is tightened down onto the hull. This keeps the fork assembly from unwanted random oscillation, and overall provides stiffening of the shade apparatus tube frames. The frame assembly for the shade apparatus is physically connected to each of the two 180-degree hinges with a simple spring-loaded marine fastening pin. The 180-degree type hinge was selected after exhaustive testing because it will conform to any shape and contour of PWC upper hull, and keep the mounting forks in a vertical position, which is necessary to attach the shade apparatus frame tubing. Additionally, referencing FIG. 2, the apparatus of the present invention is equipped with a fabric cover (10) and a zippered fabric storage cover (150) with straps for the assembly when folded and stowed. Reference FIG. 15 shows the canvas or fabric top (10) of at least 600 denier weight is sewn with an overall border to prevent fraying. Also sewn in are two cross piece pockets (135) that accept the frame cross pieces (50) in the front and rear. Also sewn around the bottom border are strips of hook and loop fastener (195) material to allow attachment of side curtain accessory products. Also sewn in the bottom are up to four storage pockets (145) made of mesh type fabric to store lightweight items such as T-shirts. These pockets are overhead of the riders for easy access when mounted on the PWC.

Figure 2A:
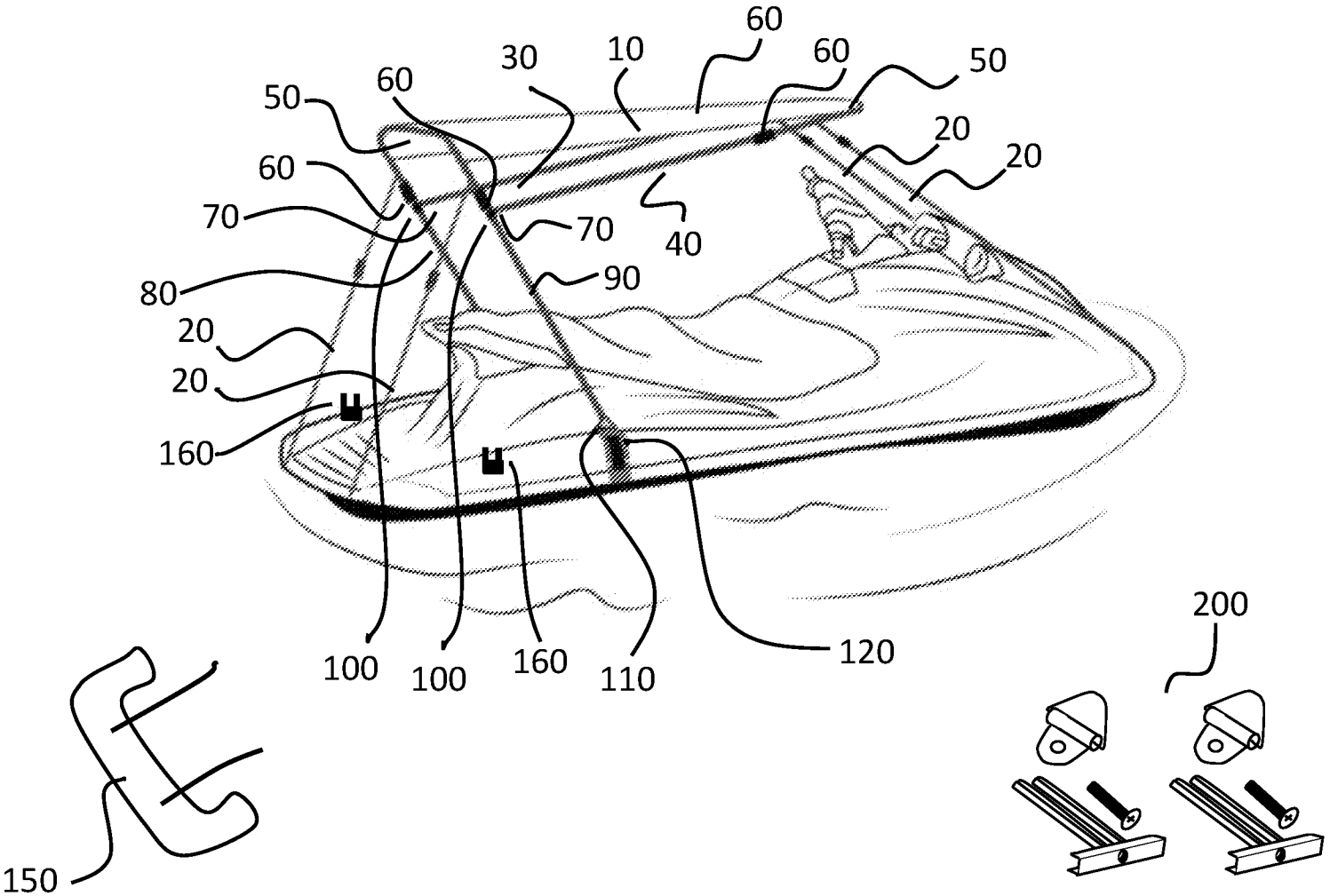
FIG. 2 shows the general components of the present invention and their locations as seen from the side.
Figure 2B:
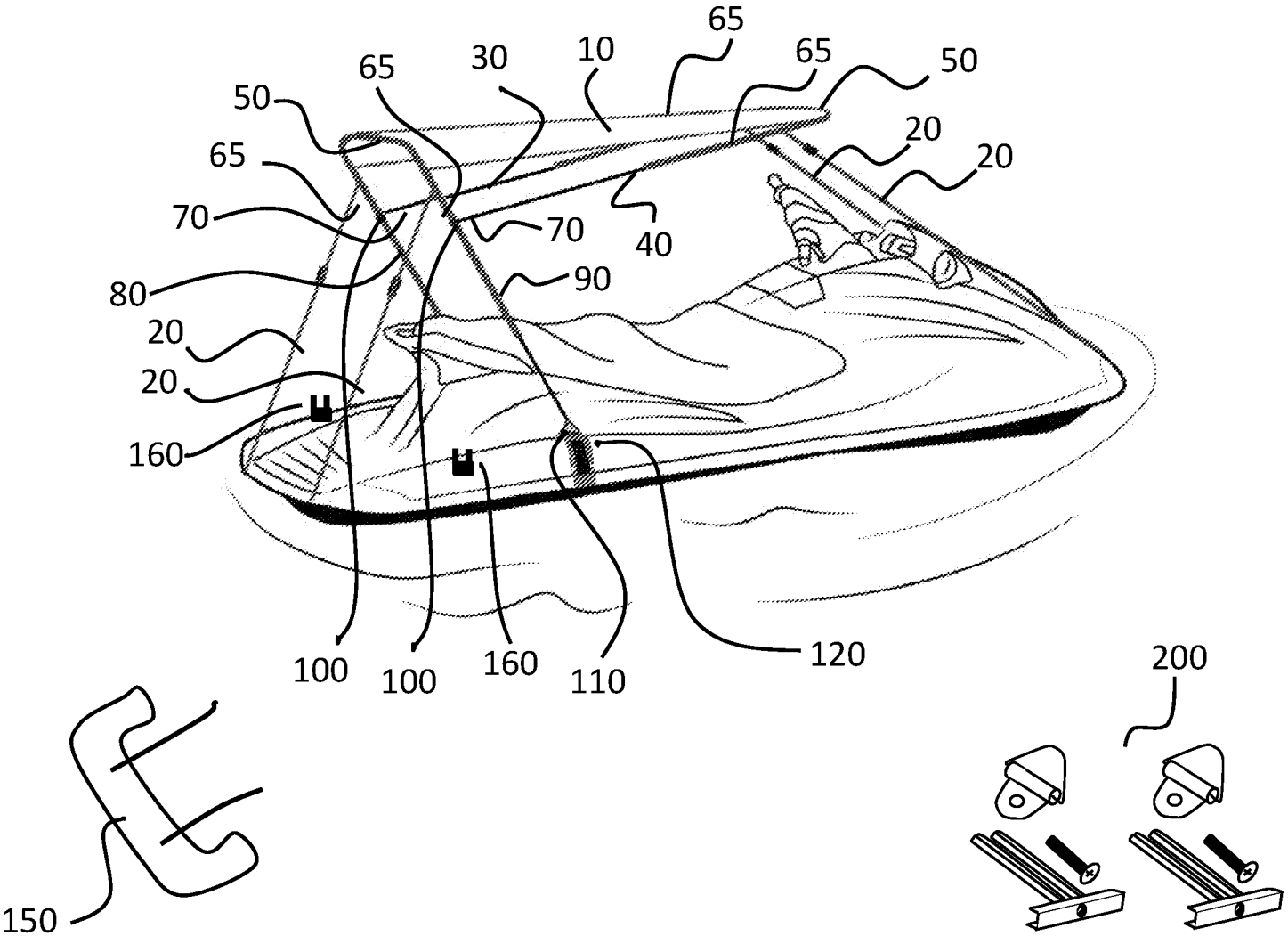
Figure 3:
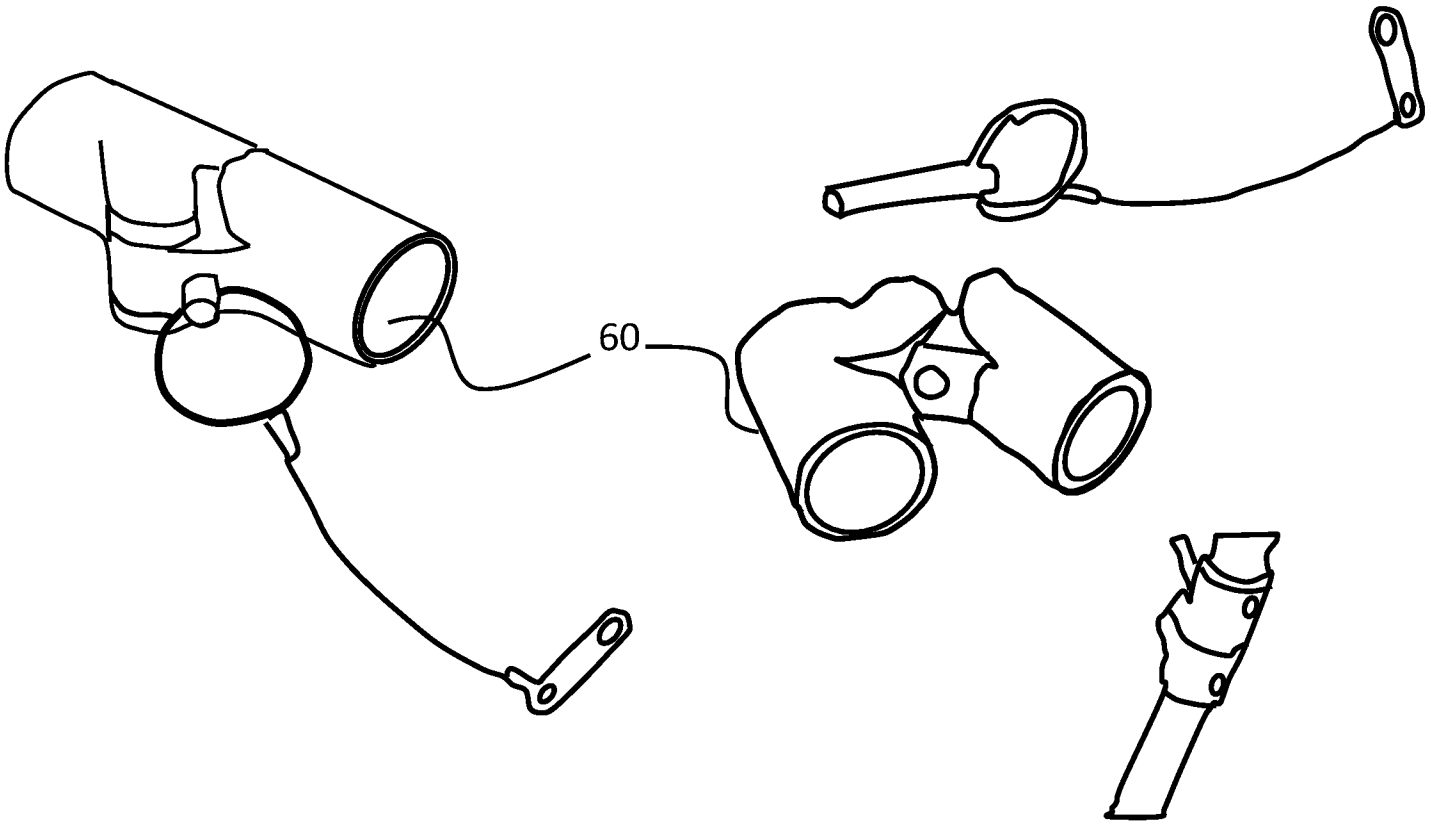
FIG. 3 shows the detail of the folding tube hinge with locking pins and lanyard part (60) of the present invention as seen from the side.
Figure 4:
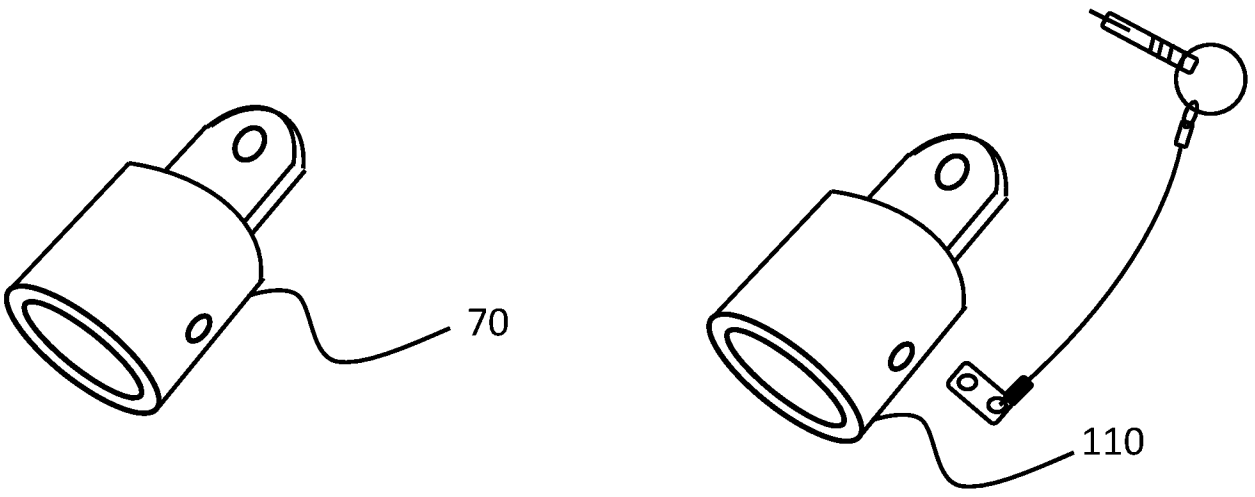
FIG. 4 shows the detail of the marine eye ends used to connect the frame tubing together parts (70) and (110) of the present invention.
Figure 5:
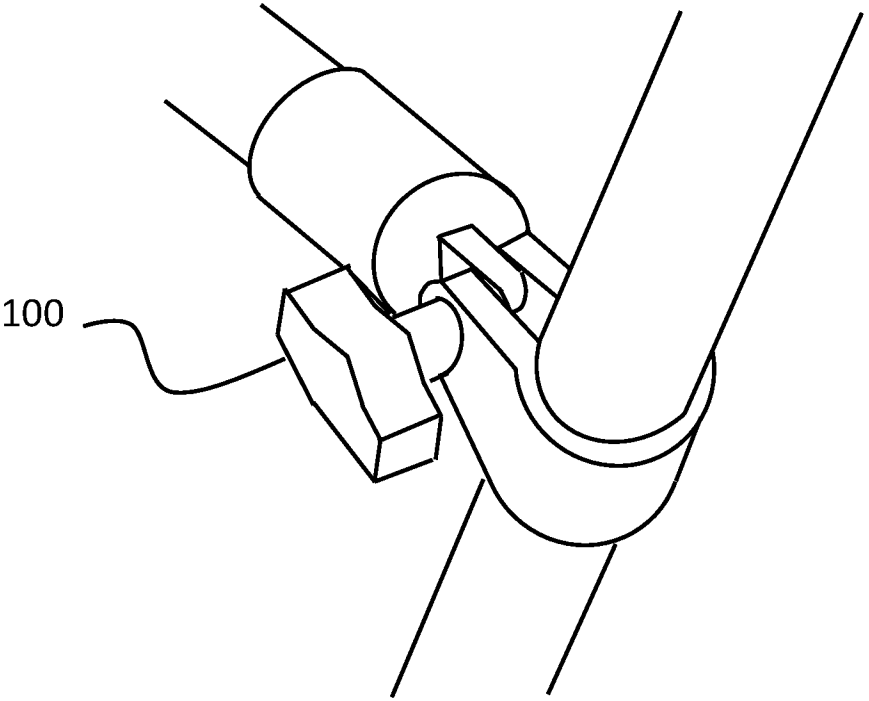
FIG. 5 shows the detail of sliding and locking jaw hinge (100) of the present invention.
Figure 6:
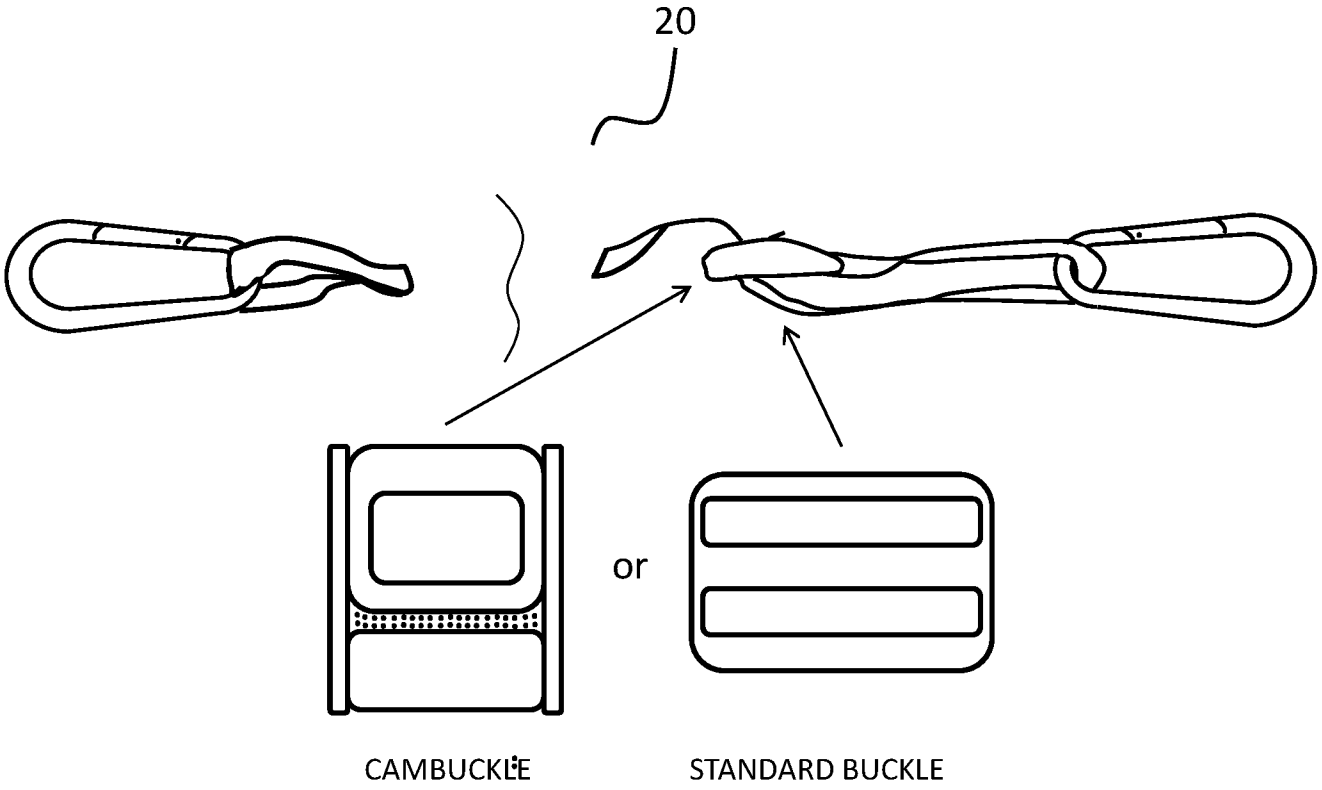
FIG. 6 shows the detail of the tether straps, buckle tensioners and snap link assembly of the present invention.
Figure 7:
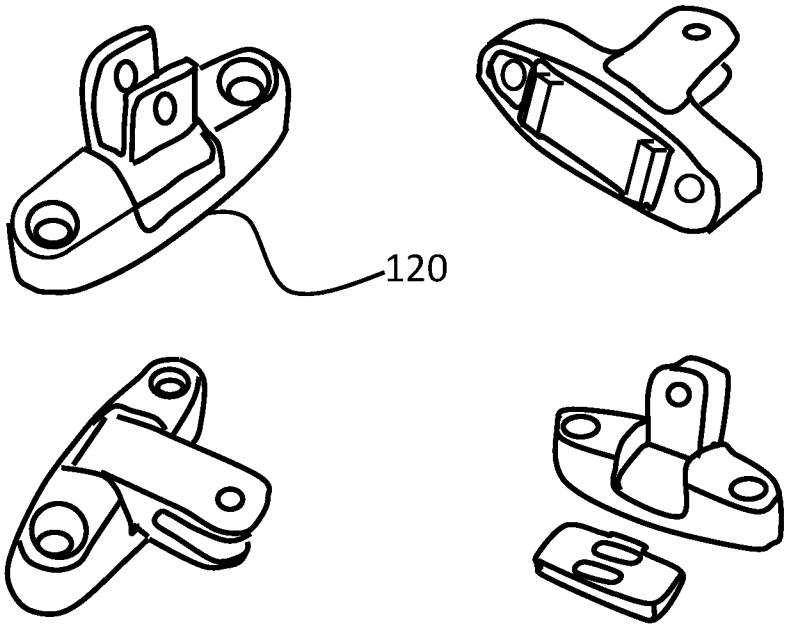
FIG. 7 shows the detail of the 180-degree deck hinge (120) of the present invention.

Referencing FIG. 2, adjustable length tether straps (20) using cambuckles or standard buckles or similar retention devices with carabiner type snap links on the ends that attach to the front tow bar of the PWC and rear transom mooring rings, or add on mooring rings for older PWCs (20) are shown. It is unique and should be noted that when using cambuckles for the tether straps (20), the fabric strap is re-routed through the cambuckle and sewn differently than what is seen on standard lashing straps using cambuckles. For PWC use, the strap is re-routed through the cambuckle so that when tension is applied to the strap, the locking piece with teeth serrations is rotated down harder into the strap preventing all slippage.

The front frame consists of a portside lateral support (30), and a starboard lateral support (40), and a lateral support connecting tube (50), The port and starboard lateral supports fold using a folding tube hinge with locking pin and lanyard that is attached to the tube (60). The port and starboard lateral supports affix to the rear frame using marine eye ends (70).

Figure 8:
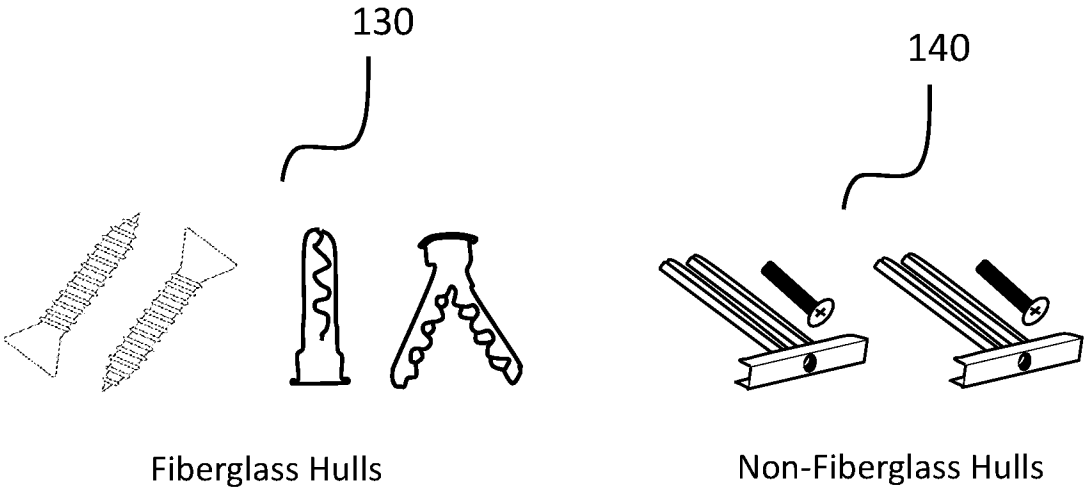
FIG. 8 shows the detail of the fiberglass and non-fiberglass hull mounting fasteners (130 and 140) of the present invention.
Figure 9:
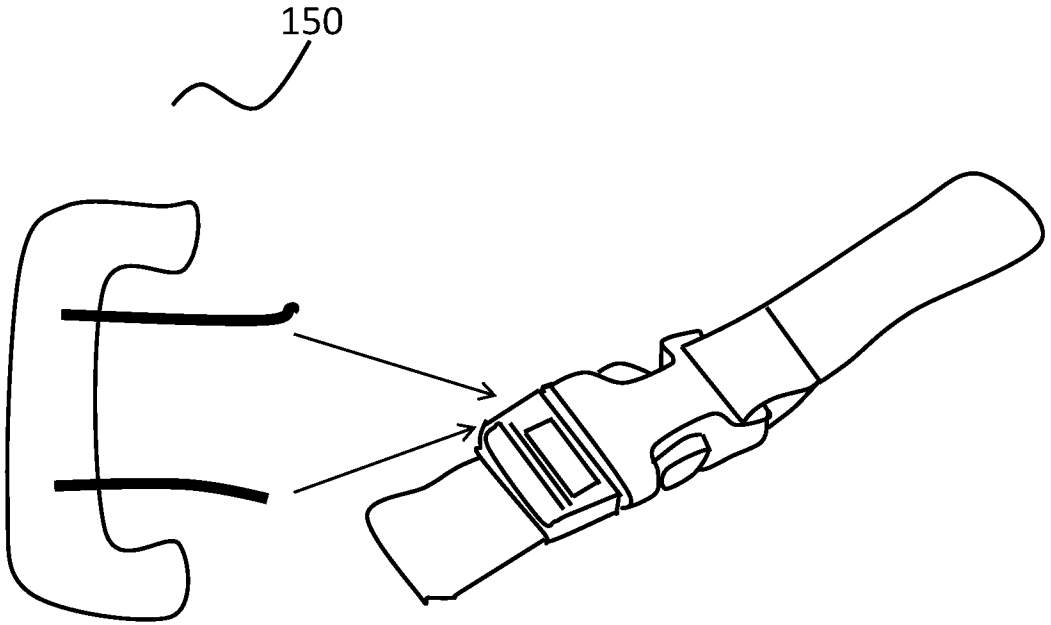
FIG. 9 shows the detail of the zippered storage boot with securing straps (150) of the present invention.

The rear frame consists of a portside vertical support (80), and a starboard vertical support (90), and a lateral support connecting tube (50). The port and starboard vertical supports fold using a folding tube hinge with locking pin (60). The port and starboard vertical supports also have sliding and jaw hinges, with locking bolts, the front frame connects into (100). The port and starboard vertical supports connect to the hull mounting system using marine eye ends secured with a locking pin attached to a lanyard that is mounted to the vertical support tubes (110). The hull mounting system utilizes a 180-degree deck hinge that is fastened through the hull or to the non-permanent mounting system (120). The fiberglass mounting system fasteners for the 180-degree deck hinge is item (130) on FIG. 8. The non-fiberglass mounting system fasteners for the 180-degree deck hinge is item (140) on FIG. 8.

The portside lateral support (30), starboard lateral support (40), portside vertical support (80), and starboard vertical support (90) are preferably fashioned of corrosion resistant aluminum. The folding hinge tube (60), the tube eye ends (70, 110), Tether Buckles and Snap Links (20), and hull mounting fasteners (130) and (140) are all preferably fashioned of stainless steel.

Figure 10:
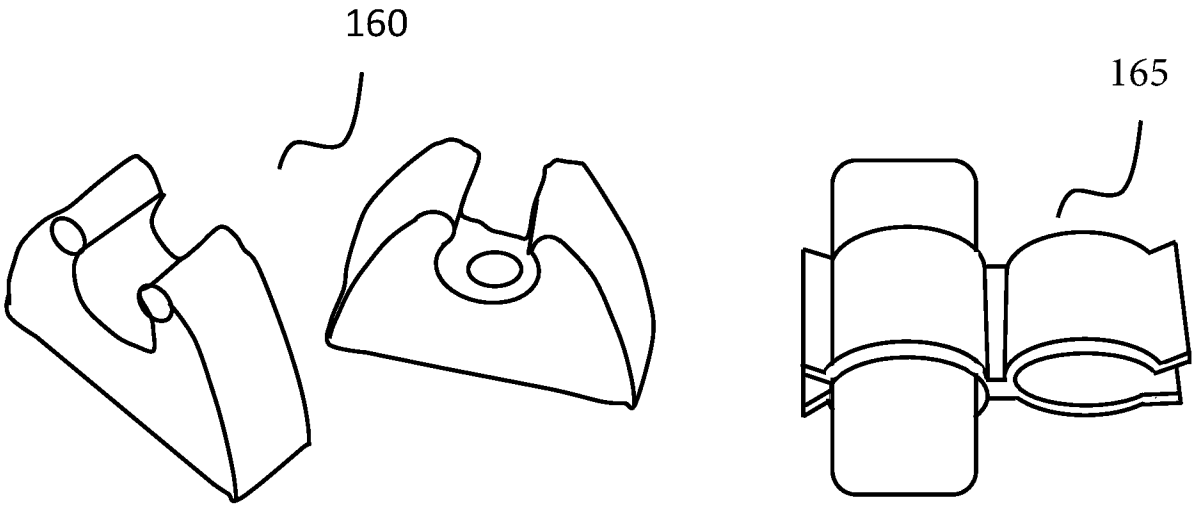
FIG. 10 shows the detail of the rubber tube holders (160) and alternate plastic tube holders (165) of the present invention.
Figure 11:
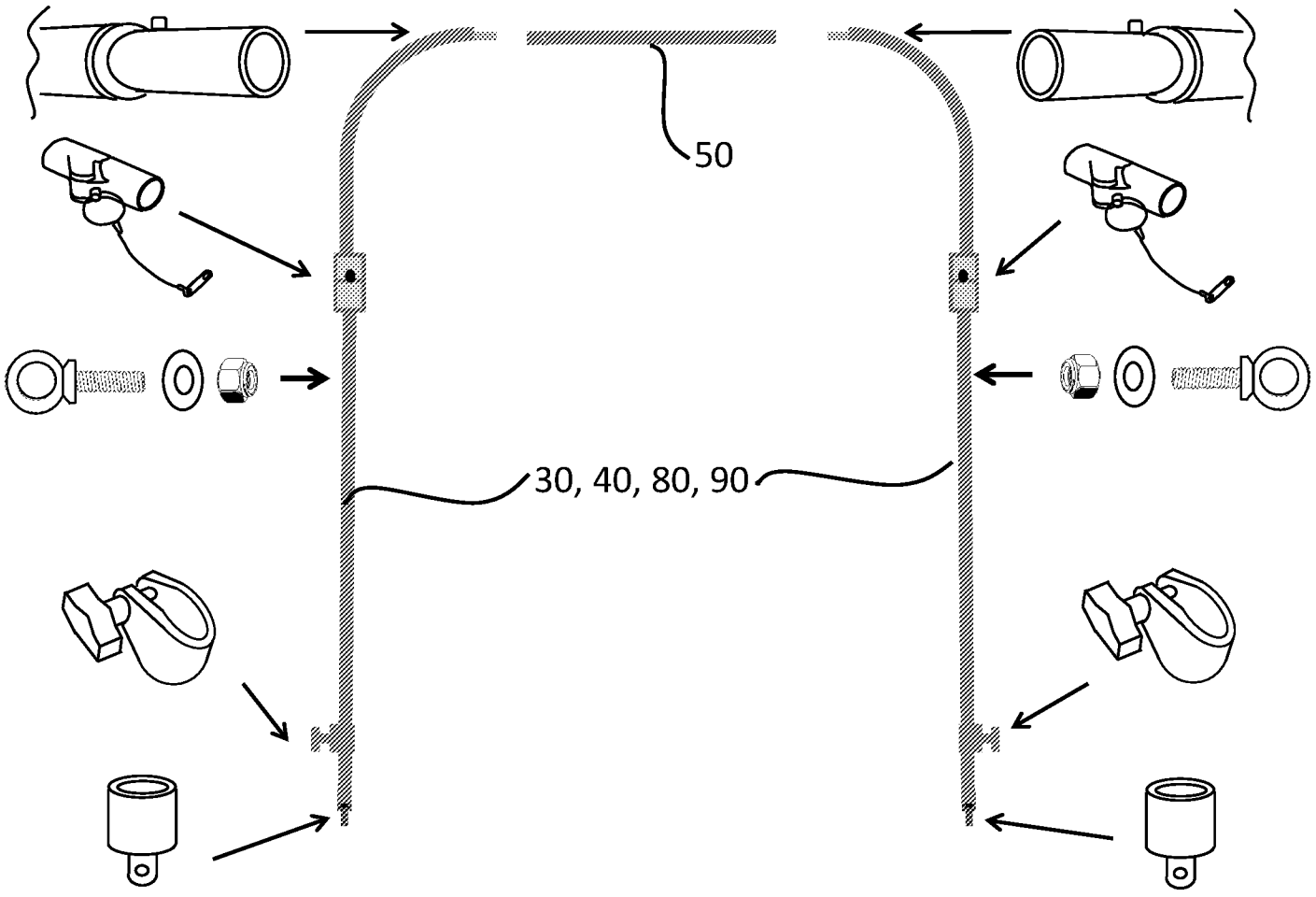
FIG. 11 shows the detail of the general arrangement of the front and rear tube frame components for the folding hinge variant embodiment of the present invention.
Figure 12:
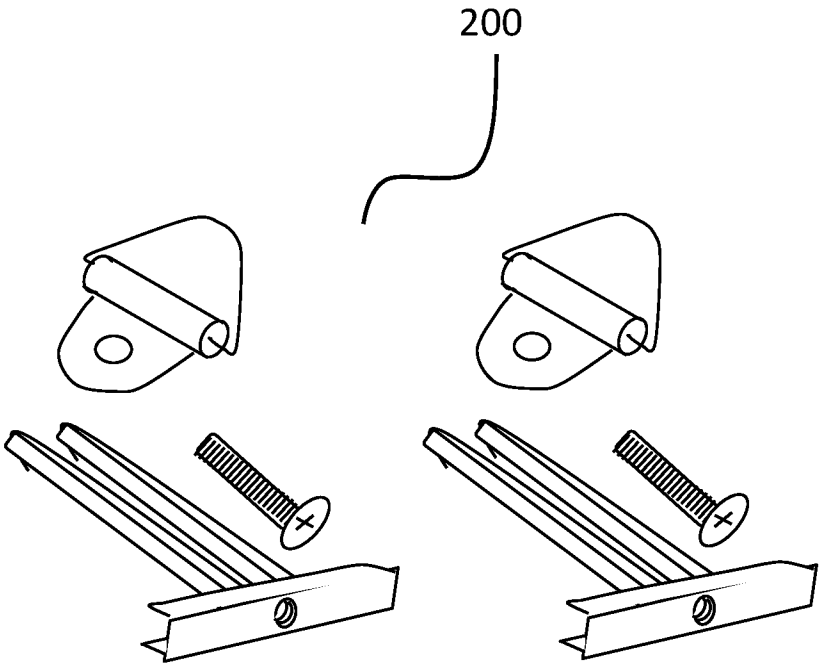
FIG. 12 shows the detail of the rear transom mooring kit of the present invention required for installation of the system to some older PWCs (200).

Referencing FIG. 10, when the entire apparatus is folded and stowed on the rear of the PWC, rubber pole holders (160) are used to elevate the tubes off of the hull surface to prevent marring. The rubber pole holders can be permanently mounted to the upper hull or simply attached when needed to the bottom tubes of the frame. Two plastic tube holders (165) or clamps are furnished loose in the kit to help maintain tube position when the entire assembly is folded down on the rear of the PWC.

As shown in reference FIG. 213, the port and starboard lateral Supports (30, 40), can also be configured with telescoping tubes (65) instead of hinges. The port and starboard vertical supports (80, 90) can also be configured with telescoping tubes (65) instead of hinges.

Telescoping is used for some longer PWCs in order to extend and retract the apparatus for stowing to the desired length depending on the PWC hull. The telescoping features supports towage behind an accessory rack mounted to the rear of the PWC.

Figure 13:
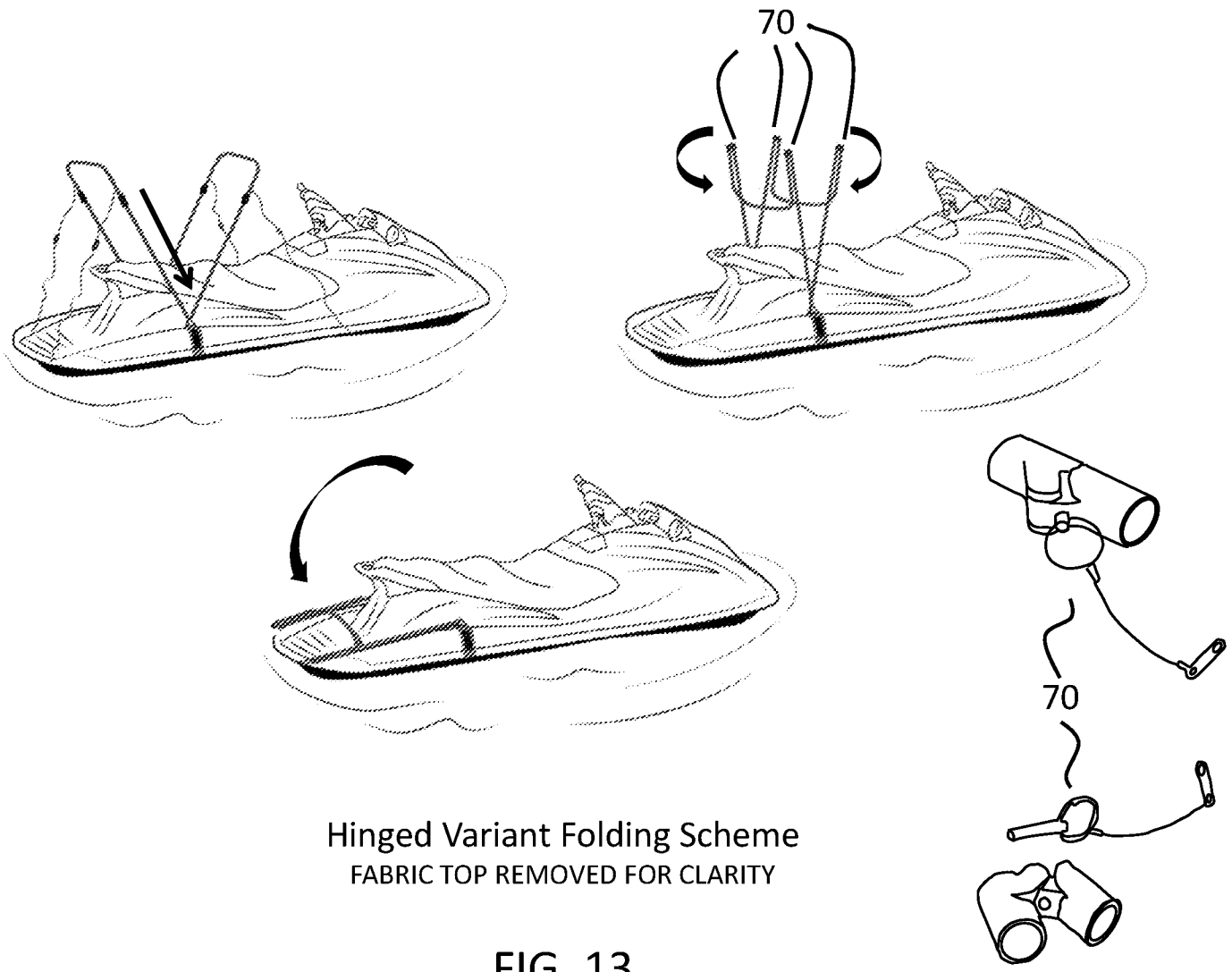
FIG. 13 shows the folding scheme of the hinged embodiment of the present invention with the bimini top fabric removed for clarity as seen from the side.
Figure 14:
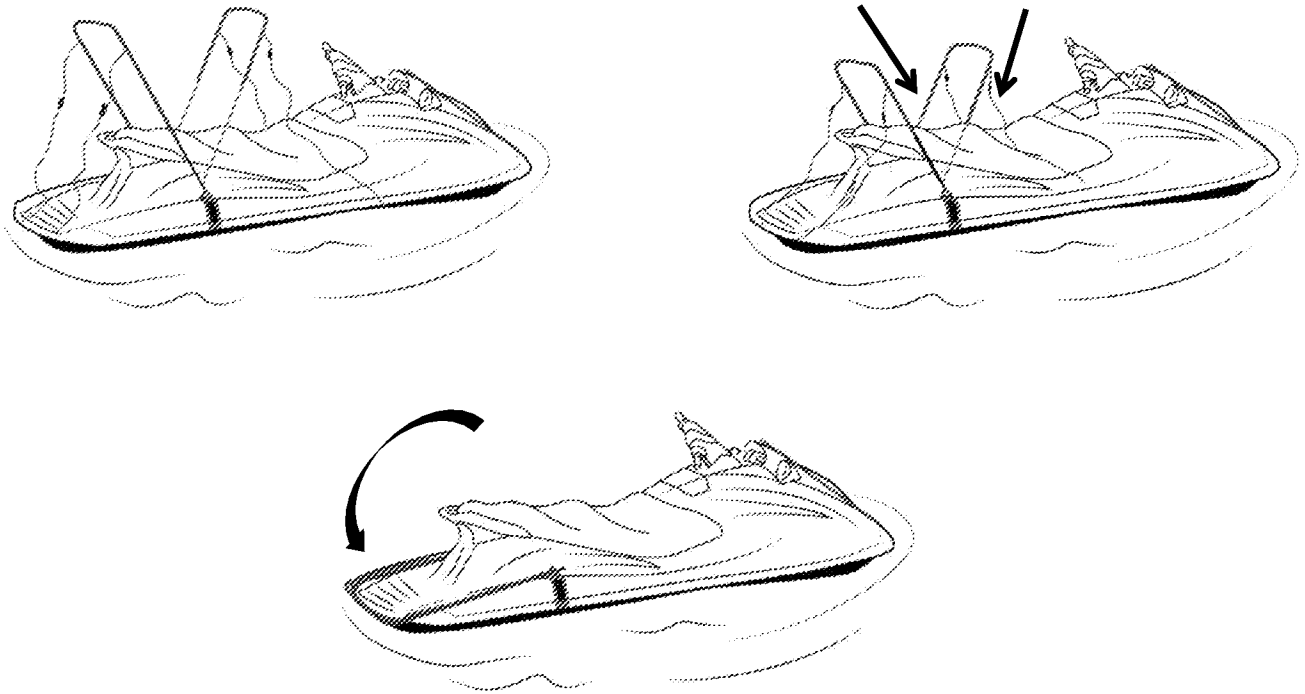
FIG. 14 shows the telescoping tube embodiment of the present invention with vertical supports with the bimini top fabric removed for clarity as seen from the side.

As seen in reference FIG. 13, this depiction shows how the hinged frames are folded and lowered to the rear of the PWC. Reference FIG. 14, this depiction shows how the telescoping frames are collapsed and folded to the rear of the PWC to accommodate OEM and third-party accessories that mount to the rear of the PWC.

Figure 16:
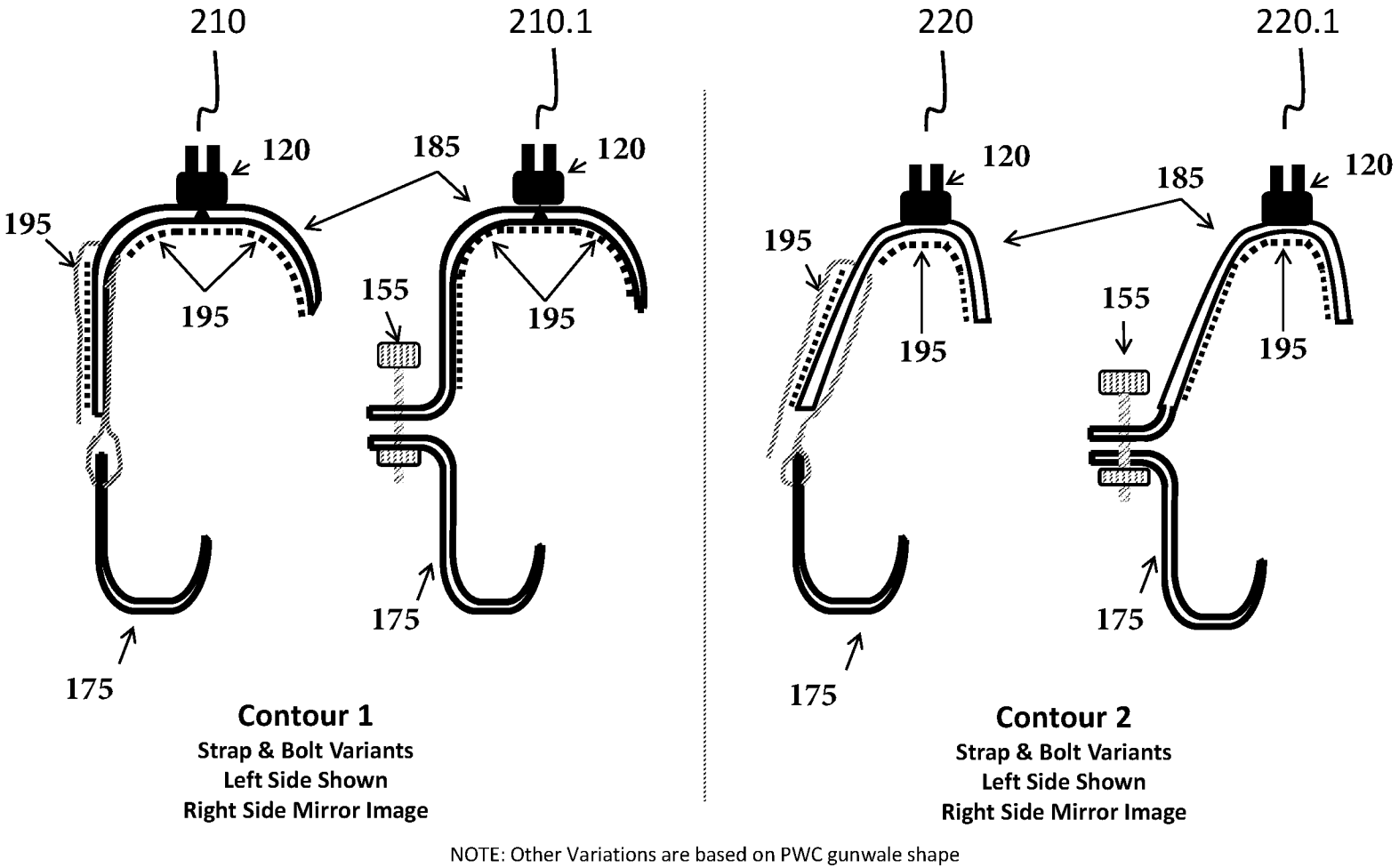
FIG. 16 depicts the mounts of the present invention as seen from the side as used on the non-permanent installation embodiment of the present invention.
Figure 17:
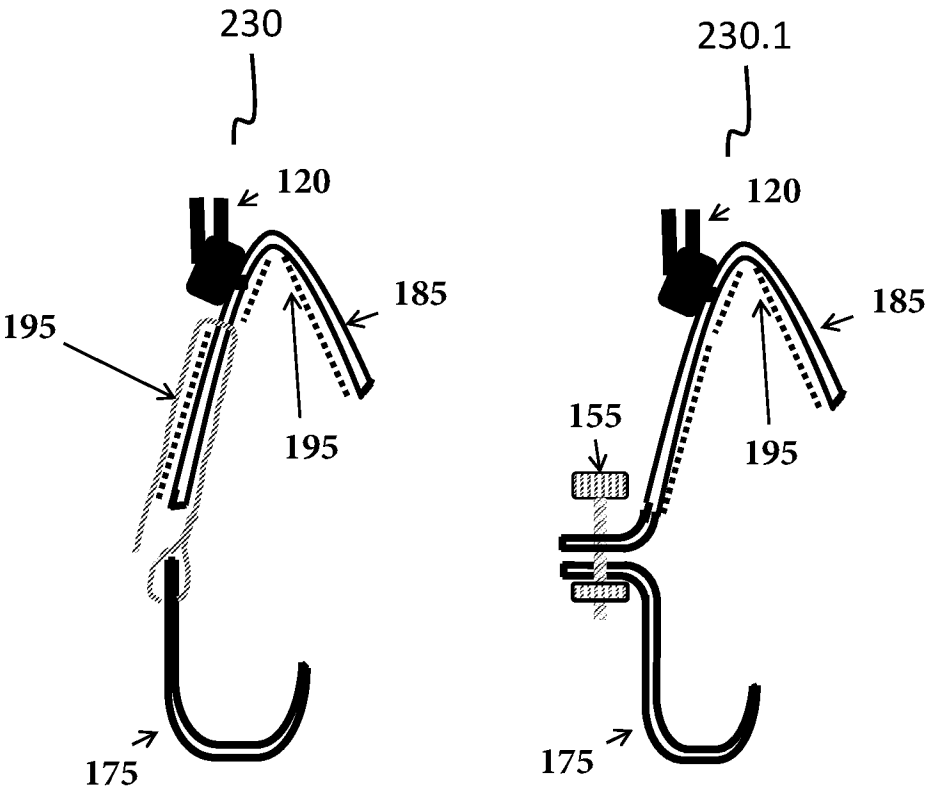
FIG. 17 shows the strap and bolt mount variants of the non-permanent embodiment of the present invention as shown from the side.

Reference FIGS. 16 and 17 show the unique, non-permanent mounting systems for the shade apparatus to connect to the upper hull gunwale area without having to drill holes (210, 210.1, 220, 220.1, 230, 230.1). These depictions show three basic variants that will attach to most hull form factors and contours via an upper gunwale mount (185) and a bottom gunwale hook (175). Some make and model years of PWCs can adequately attach using the hook and loop strap method via hook and loop connectors (195). Hook and loop connectors (195) are similarly installed to the hull to connect to the hook and loop connectors (195) disposed on the upper gunwale mounts (185). Other make and model year hulls require more force to keep the mount secure, and therefore require the bolt tightening variant shown as 210.1 and 220.1 in FIG. 16. The upper gunwale mounts (185) and bottom gunwale hooks (175) are made of a lightweight corrosion resistant metal. The inner portion of the top hull mount preferably has male hook and loop style material applied. Female hook and loop type fastener material is applied to the area of the upper hull gunwale the mount will attach to. The hook and loop type material (195) has adhesive which is rated for high temperatures in order to withstand the high surface temperatures generated by solar heating of the PWC hull. The bottom gunwale hook (175) attaches under the gunwale that exists on all PWCs. The 180-degree hinge (120) is also used on these mounts and is attached with bolts (155) and a marine grade permanent adhesive.

The process of installing the shade top apparatus of the present invention to a PWC, as depicted in FIG. 19, is preferably as follows:

1. First the user purchases the apparatus of the present invention from a retailer or e-retailer. (300)

2. Next, the user unpackages the components of the present invention and inspects that all parts are present and for shipping damage. (310)

3. Then, the user installs the permanent or non-permanent hull mount kit. (320)

4. Then, the user inserts the cross pieces (50) on a first end of the vertical and lateral supports 30, 80 until the snap button locks into place in the holes in the cross piece. (330)

5. Then, the user inserts the cross pieces (50) on a second end of the vertical and lateral supports 30, 80 until the snap button locks into place in the holes in the cross piece. (340)

6. Then, the other vertical and lateral supports (40, 90) are attached to the cross pieces (50) and locked into place until the snap button locks into place in the holes in the cross piece. Then the fabric top (10) is spread out evenly across the frames. (350)

7. Then, the user attaches the front frame with lateral supports (30,40) to the rear frame vertical supports (80, 90) using the Locking Jaw Slides on the rear vertical supports. (360)

8. Then, the entire assembly and vertical support eye ends are inserted into the hull mounts and secured with the locking pins. (370)

9. Then, the front and rear frames are either folded open or extended to operating length, and secured with built-in pins, or via snap buttons in the tubing for the telescoping variant. (380)

10. Then, the user affixes the four tether straps (20) to the two lateral supports (30,40) and the two vertical supports (80, 90) at the eye bolts on each support. (390)

11. The apparatus is now prepared for formal raising up on the PWC. The user, while standing next to the PWC, affixes the port and starboard front tether straps (20) to the tow bar on the front of the PWC. (400)

12. Next, the user raised up the rear vertical supports, extending the fabric top, and affixes the port and starboard rear tether straps to the transom mooring rings on the rear of the PWC. (410)

13. Next, the user raises the jaw slides (100) attached to the port and starboard lateral supports, up the vertical supports until 1 inch below the eyebolts on the vertical supports. (420)

14. Then the bolt on the jaw slide is tightened down knob to lock them in place. (430)

15. Finally, the user tightens all tether straps until sufficient tension is achieved, tightening the overall structure of the apparatus to ensure it remains in position, and ensuring the bimini top is in a level position above the PWC. (440)

It should be understood that the Bimini Top (10) of the present invention is preferably fashioned of a durable fabric such as canvas, however other suitable weather-repellent and UV resistant materials may be employed. The fabric used is preferably 600 Denier polyester which is UV resistant. Similarly, it should be noted that the straps of the present invention are preferably fashioned of durable UV resistant polymers, and are capable of maintaining tensions with minimal (if any) stretching. Additionally, it should be understood that the lateral supports (30, 40), vertical supports (80, 90), and Cross Pieces (50) are preferably fashioned of a durable, light weight corrosion resistant material, and are configured to fold or telescope to ensure that the apparatus may be easily stowed and put away at the aft of the PWC when not in use. The thickness of the tubing of these supports is thicker than that of standard bimini top tubing found on boats and is a trade secret which maximizes strength while maintaining minimal added weight.

A lock-and-button type of telescoping system may be employed, or a similarly equipped friction lock, or a folding hinge with a locking pin may be used to ensure that the supports remain in the desired position during use. Other conventional means of locking the supports may be similarly employed based on manufacturing cost.

Figure 18:
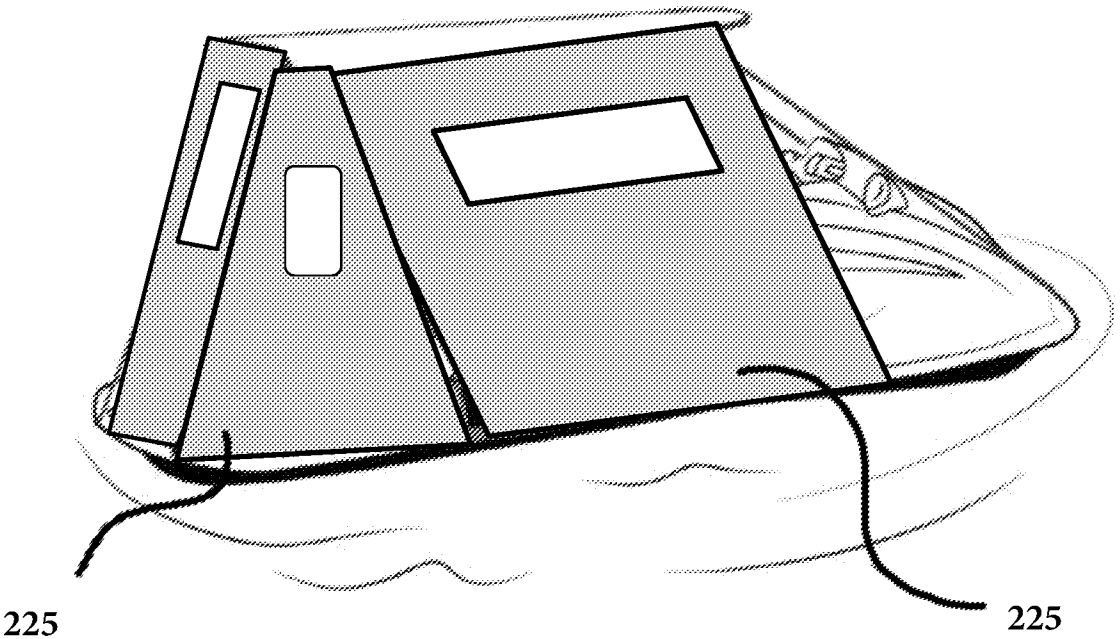
FIG. 18 shows an accessory compatible with both embodiments of the present invention, a weather curtain configured for use when the PWC is docked or beached as shown from the side.

Additionally, the apparatus of the present invention enables users to attach accessories such as weather curtains (225) to the front, sides, and rear of the Bimini Top (10) as depicted in FIG. 18. Accessories are preferably mounted to the Bimini Top (10) via hook and loop type fastener material. Likewise, the bottoms of the curtains are preferably affixed to the top of the gunwale of the PWC with nylon hooks. It should be understood that the curtains are not to be used while the PWC is underway.

Some alternate embodiments of the present invention are preferably outfitted with additional accessories such as blue tooth speakers. It is envisioned that such accessories, including the speakers may be purchased separately if not originally included in the purchased package. The speaker mount is preferably fashioned of PVC, and is configured to clamp onto the lateral or vertical supports (30,40, 80,90) of the present invention. As such, it should be noted that up to four speaker mounts may be easily positioned, facilitating the positioning of up to four speakers on the apparatus.

Another accessory envisioned for use with the apparatus and system of the present invention is a work table accessory which is preferably mounted to one or more of the vertical supports (80, 90) of the present invention via at least one clamp. The work table accessory is preferably fashioned out of PVC to ensure maximum durability.

Other accessories envisioned for use with the apparatus and system of the present invention include a saddlebag accessory, an expedition bag accessory, a cooler bag accessory, and a fishing pole holding tube. Each accessory is similarly mounted to the vertical supports (80, 90) of the present invention with an auxiliary telescoping support tube that connects to the vertical support tubes of the vertical supports (80, 90) with a jaw slide (100) and attaches to the upper hull aft of the vertical supports.

It should also be noted that, due to the placement of the vertical supports (80, 90), and tether straps (20), the apparatus of the present invention does not impede the use of common PWC accessories conventionally placed on the transom of the PWC, including coolers, expedition bags, fishing gear, and the like.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

We claim:

1. A shade apparatus for a Personal Watercraft (PWC) having a starboard side and port side comprising:

a fabric top having a front edge and a rear edge;

port and starboard vertical supports having upper and lower ends;

port and starboard lateral supports affixed to said vertical supports proximate said upper ends;

at least one lateral support connecting tube;

wherein said at least one lateral support connecting tube is disposed in communication with the front edge of said fabric top;

wherein said at least one lateral support connecting tube connects to said port and starboard lateral supports;

wherein said vertical supports are configured to support the rear edge of said fabric top on both the starboard side and port side of the PWC;

a port gunwale mount and a starboard gunwale mount, said port gunwale mount and said starboard gunwale mount disposed in communication with the lower ends of said vertical supports;

wherein said port gunwale mount and said starboard gunwale mount are configured to attach to a gunwale of the PWC disposed on the port side and starboard side of the PWC respectively, aft of a midpoint of a length of the PWC;

wherein placement of said port gunwale mount and said starboard gunwale mount provides unimpeded access to sides of the PWC for boarding and unboarding;

at least one strap, said at least one strap disposed in communication with the PWC and at least one of said lateral supports;

wherein said at least one strap is configured to stabilize the fabric top upon erection of said vertical supports.

2. The apparatus of claim 1, wherein said vertical supports are configured to telescope.

3. The apparatus of claim 2, wherein said lateral supports are configured to telescope.

4. The apparatus of claim 2, wherein said vertical supports are equipped with hinges which facilitate their connection to said lateral supports.

5. The apparatus of claim 2, further comprising:

180-degree deck hinges;

pins, said pins configured to maintain the connection of said 180-degree deck hinges to said vertical supports;

wherein said 180-degree deck hinges are disposed on said gunwale mounts; and bolts, said bolts configured to connect said 180-degree deck hinges to a hull of the PWC.

6. The apparatus of claim 1, wherein said lateral supports are configured to telescope.

7. The apparatus of claim 1, wherein said lateral supports are configured to fold about a hinge; and wherein said lateral supports freely fold down and to a rear of the PWC upon disconnection of said at least one strap.

8. The apparatus of claim 1, wherein said vertical supports are equipped with hinges which facilitate their connection to said lateral supports.

9. The apparatus of claim 1, further comprising:

180-degree deck hinges, said 180-degree deck hinges disposed on the port gunwale mount and the starboard gunwale mount;

pins, said pins configured to maintain the connection of said 180-degree deck hinges to said vertical supports;

wherein said 180-degree deck hinges are equipped with a pivoting eye through which said pins traverse;

and bolts, said bolts configured to connect said 180-degree deck hinges to a hull of the PWC.

10. A shade apparatus for a Personal Watercraft (PWC) having a gunwale, a starboard side, and port side comprising:

a fabric top having a front edge and a rear edge;

port and starboard vertical supports having upper and lower ends;

port and starboard lateral supports affixed to said vertical supports proximate said upper ends;

at least one lateral support connecting tube, said at least one lateral support connecting tube disposed in a tube pocket sewn into said fabric top;

wherein said tube pocket is disposed at the front edge of said fabric top;

wherein said at least one lateral support connecting tube connects to said port and starboard lateral supports;

wherein said vertical supports are configured to support the rear edge of said fabric top;

gunwale mounts disposed beyond a midpoint of the gunwale of the PWC towards the rear of the PWC, providing for uninfringed boarding of the PWC from the starboard side and port side of the PWC, said gunwale mounts in communication with said vertical supports;

wherein said gunwale mounts are configured to attach to the gunwale of the PWC;

at least one strap, said at least one strap disposed in communication with the PWC and at least one of said lateral supports;

wherein said at least one strap is configured to stabilize said fabric top 180-degree deck hinges;

pins, said pins configured to maintain the connection of said 180-degree deck hinges to said vertical supports;

wherein said 180-degree deck hinges are disposed on said gunwale mounts; and bolts, said bolts configured to connect said 180-degree deck hinges to a hull of the PWC.

* * * * *